US006234387B1

(12) United States Patent
Cuthbert et al.

(10) Patent No.: US 6,234,387 B1
(45) Date of Patent: May 22, 2001

(54) MAIL BOX INSERT ASSEMBLY

(76) Inventors: Julius Cuthbert; Gilda V. Cuthbert, both of 7219 Velvet Oaks Ct., Jacksonville, FL (US) 32277

( * ) Notice: Subject to any disclaimer, the term of this patent is extended or adjusted under 35 U.S.C. 154(b) by 0 days.

(21) Appl. No.: 09/426,787

(22) Filed: Oct. 22, 1999

(51) Int. Cl.[7] ..... B65D 91/00

(52) U.S. Cl. ..... 232/29; 232/17; 232/38; 232/45

(58) Field of Search ..... 232/38, 39, 29, 232/33, 17, 45

(56) References Cited

U.S. PATENT DOCUMENTS

| | | | |
|---|---|---|---|
| D. 365,189 | | 12/1995 | Dennis . |
| 3,107,848 | | 10/1963 | Penta . |
| 4,244,512 | * | 1/1981 | Wise . |
| 4,368,842 | | 1/1983 | De Lange, III . |
| 4,375,869 | | 3/1983 | Hatch . |
| 4,600,143 | | 7/1986 | Hailow, Jr. et al. . |
| 4,813,595 | | 3/1989 | Johns, Jr. et al. . |
| 4,875,622 | * | 10/1989 | Lents . |
| 5,361,977 | * | 11/1994 | Ogrodnick, Jr. . |
| 5,524,818 | * | 6/1996 | Patry et al. . |
| 6,123,257 | * | 9/2000 | Guidicy . |

* cited by examiner

*Primary Examiner*—Lynne H. Browne
*Assistant Examiner*—William L. Miller
(74) *Attorney, Agent, or Firm*—Joseph N. Breaux

(57) ABSTRACT

A mail box insert that includes a decorative facade plate and that is insertable into an existing mail receiving compartment of an existing mail box housing and secured in place to refurbish the appearance of the existing mail box. The mail box insert is held in place with opposed securing screw assemblies that generate a compressional force against the inner surfaces of the existing mail box sidewalls.

1 Claim, 1 Drawing Sheet

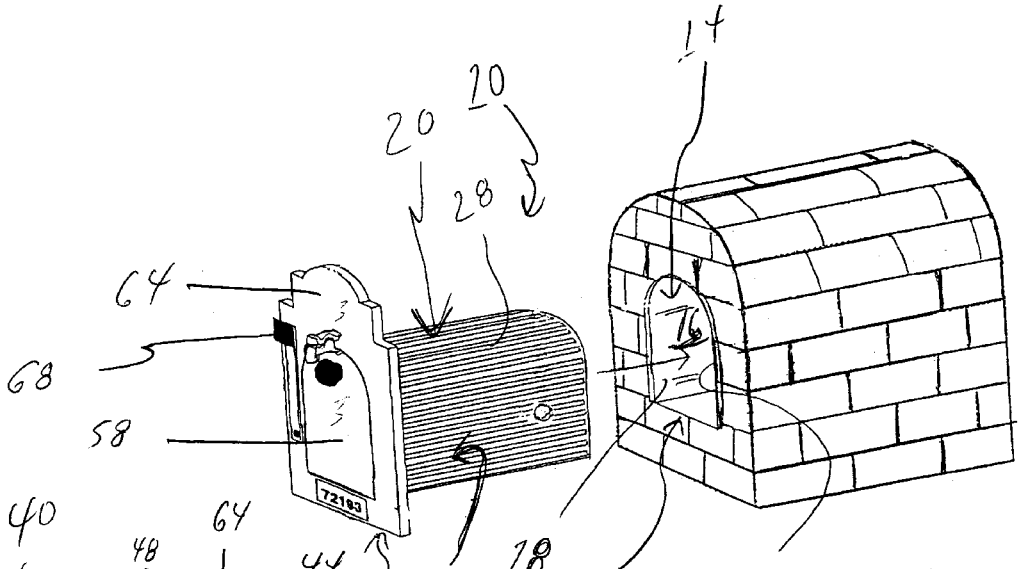
Fig. 1
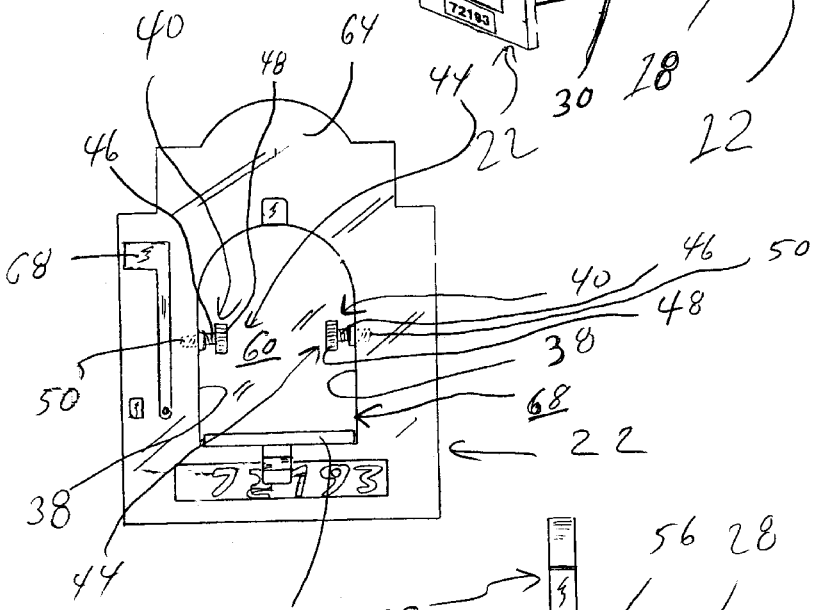
Fig. 3
Fig. 2
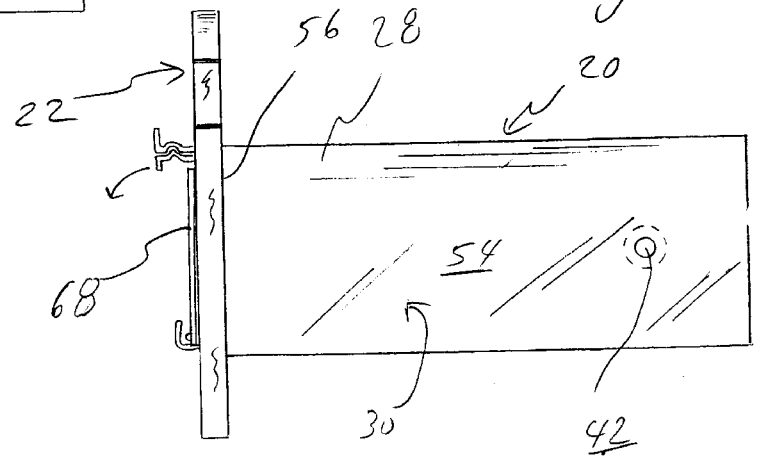

MAIL BOX INSERT ASSEMBLY

TECHNICAL FIELD

The present invention relates to mail boxes and the like and more particularly to a mail box insert assembly for use with an existing mail box housing having an open front end in connection with an existing mail compartment; the mail box insert assembly including a housing insert portion integrally formed with a facade plate assembly; the housing insert portion having a curved top portion and a rectangular bottom portion and is sized to frictionally slide completely into the open front end of the existing mail box housing and into the existing mail compartment thereof defined by existing housing sidewalls; the rectangular bottom portion having opposed vertical sidewalls that are each provided with a thumb screw securing assembly including a threaded opening formed through the vertical sidewall and a thumb screw including a threaded shaft portion companionately threaded to engage the threaded opening of the vertical sidewall and a knob portion; the threaded shaft being of sufficient length such that a tip end of the threaded shaft is threadably extendable past an exterior side surface of the vertical sidewall at least one-half inch so as to contact the existing housing sidewalls and secure the housing insert portion within the existing mail compartment; the facade plate assembly being integrally formed with a front edge of the housing insert portion and including a pivoting access door in connection with a mail receiving cavity formed within the housing insert portion, a decorative facade plate defining an access opening in connection with the mail receiving cavity of the housing insert portion, and a mail flag pivotally attached to the facade plate.

BACKGROUND ART

Mail boxes are often permanently bricked into a decorative structure. Although the bricked in mail box looks good for a period of time, as time passes, the bricked in mail boxes can begin to rust or otherwise become unattractive. It would be desirable, therefore, to have a mail box insert that included a decorative facade plate and that could be inserted into the existing mail receiving compartment of the existing mail box housing and secured in place to refurbish the appearance of the combined mail box and brick decorative structure.

GENERAL SUMMARY DISCUSSION OF INVENTION

It is thus an object of the invention to provide a mail box insert assembly for use with an existing mail box housing having an open front end in connection with an existing mail compartment; the mail box insert assembly including a housing insert portion integrally formed with a facade plate assembly; the housing insert portion having a curved top portion and a rectangular bottom portion and is sized to frictionally slide completely into the open front end of the existing mail box housing and into the existing mail compartment thereof defined by existing housing sidewalls; the rectangular bottom portion having opposed vertical sidewalls that are each provided with a thumb screw securing assembly including a threaded opening formed through the vertical sidewall and a thumb screw including a threaded shaft portion companionately threaded to engage the threaded opening of the vertical sidewall and a knob portion; the threaded shaft being of sufficient length such that a tip end of the threaded shaft is threadably extendable past an exterior side surface of the vertical sidewall at least one-half inch so as to contact the existing housing sidewalls and secure the housing insert portion within the existing mail compartment; the facade plate assembly being integrally formed with a front edge of the housing insert portion and including a pivoting access door in connection with a mail receiving cavity formed within the housing insert portion, a decorative facade plate defining an access opening in connection with the mail receiving cavity of the housing insert portion, and a mail flag pivotally attached to the facade plate.

Accordingly, a mail box insert assembly for use with an existing mail box housing having an open front end in connection with an existing mail compartment is provided. The mail box insert assembly includes a housing insert portion integrally formed with a facade plate assembly; the housing insert portion having a curved top portion and a rectangular bottom portion and is sized to frictionally slide completely into the open front end of the existing mail box housing and into the existing mail compartment thereof defined by existing housing sidewalls; the rectangular bottom portion having opposed vertical sidewalls that are each provided with a thumb screw securing assembly including a threaded opening formed through the vertical sidewall and a thumb screw including a threaded shaft portion companionately threaded to engage the threaded opening of the vertical sidewall and a knob portion; the threaded shaft being of sufficient length such that a tip end of the threaded shaft is threadably extendable past an exterior side surface of the vertical sidewall at least one-half inch so as to contact the existing housing sidewalls and secure the housing insert portion within the existing mail compartment; the facade plate assembly being integrally formed with a front edge of the housing insert portion and including a pivoting access door in connection with a mail receiving cavity formed within the housing insert portion, a decorative facade plate defining an access opening in connection with the mail receiving cavity of the housing insert portion, and a mail flag pivotally attached to the facade plate.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 1 is an exploded perspective view of an exemplary embodiment of the mail box insert assembly positioned in front of an existing mail box housing; the mail box insert assembly including a housing insert portion integrally formed with a facade plate assembly; the housing insert portion having a curved top portion and a rectangular bottom portion and is sized to frictionally slide completely into an open front end of the existing mail box housing; the rectangular bottom portion having opposed vertical sidewalls that are each provided with a thumb screw securing assembly including a threaded opening formed through the vertical sidewall and a thumb screw including a threaded shaft portion companionately threaded to engage the threaded opening of the vertical sidewall and a knob portion; the threaded shaft being of sufficient length such that a tip end of the threaded shaft is threadably extendable past an exterior side surface of the vertical sidewall at least one-half inch; the facade plate assembly being integrally formed with a front edge of the housing insert portion and including a pivoting access door in connection with a mail receiving cavity formed within the housing insert portion, a decorative facade plate defining an access opening in connection with the mail receiving cavity of the housing insert portion, and a mail flag pivotally attached to the facade plate.

FIG. 2 is a side plan view of the mail box insert assembly of FIG. 1.

FIG. 3 is a front plan view of the mail box insert of FIG. 1 with the pivoting access door pivoted into a down position allowing access into the mail receiving cavity through the access opening of the decorative facade plate.

EXEMPLARY MODE FOR CARRYING OUT THE INVENTION

FIG. 1 shows an exemplary embodiment the mail box insert assembly of the present invention, generally designated 10, positioned in front of a representative existing mail box housing, generally designated 12, having an open front end 14 in connection with an existing mail compartment 16 defined by existing housing sidewalls 18.

Mail box insert assembly 10 is of molded plastic construction and includes a housing insert portion, generally designated 20, and a facade plate assembly, generally designated 22, integrally formed with housing insertion portion 20. Referring also to FIGS. 2 and 3, housing insert portion 20 has a curved top portion 28 and a rectangular bottom portion 30. Housing insert portion 20 is sized to frictionally slide completely into the open front end 14 of existing mail box housing 12 and into the existing mail compartment 16 thereof that is partially defined by existing opposed vertical housing sidewalls 18. Rectangular bottom portion 30 has opposed vertical sidewalls 38 that are each provided with a thumb screw securing assembly, generally designated 40. Each thumb screw securing assembly 40 includes a threaded opening 42 formed through a respective vertical sidewall 38 and a thumb screw, generally designated 44, including a threaded shaft portion 46 that is companionately threaded to engage threaded opening 42 and a knob portion 48. Threaded shaft 46 is of sufficient length such that a tip end 50 of threaded shaft 46 is threadably extendable past an exterior side surface 54 of vertical sidewall 38 at least one-half inch so as to contact an existing housing sidewall 18 and generate a compression force against existing housing sidewall 18 sufficient to secure housing insert portion 20 within existing mail compartment 16.

Facade plate assembly 22 is integrally formed with a front edge 56 of housing insert portion 20 and includes a pivoting access door 58 in connection with a mail receiving cavity 60 formed within housing insert portion 20; a decorative facade plate 64 defining an access opening 68 in connection with mail receiving cavity 60 of housing insert portion 20, and a mail flag 68 pivotally attached to facade plate 64.

It can be seen from the preceding description that a mail box insert assembly a mail box insert assembly for use with an existing mail box housing having an open front end in connection with an existing mail compartment is provided wherein the mail box insert assembly includes a housing insert portion integrally formed with a facade plate assembly; the housing insert portion having a curved top portion and a rectangular bottom portion and is sized to frictionally slide completely into the open front end of the existing mail box housing and into the existing mail compartment thereof defined by existing housing sidewalls; the rectangular bottom portion having opposed vertical sidewalls that are each provided with a thumb screw securing assembly including a threaded opening formed through the vertical sidewall and a thumb screw including a threaded shaft portion companionately threaded to engage the threaded opening of the vertical sidewall and a knob portion; the threaded shaft being of sufficient length such that a tip end of the threaded shaft is threadably extendable past an exterior side surface of the vertical sidewall at least one-half inch so as to contact the existing housing sidewalls and secure the housing insert portion within the existing mail compartment; the facade plate assembly being integrally formed with a front edge of the housing insert portion and including a pivoting access door in connection with a mail receiving cavity formed within the housing insert portion, a decorative facade plate defining an access opening in connection with the mail receiving cavity of the housing insert portion, and a mail flag pivotally attached to the facade plate.

It is noted that the embodiment of the mail box insert assembly described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A mail box insert assembly for use with an existing mail box housing having an open front end in connection with an existing mail compartment defined by existing housing sidewalls, said mail box insert assembly comprising:

a housing insert portion; and a facade plate assembly integrally formed with said housing insert portion;

said housing insert portion having a curved top portion and a rectangular bottom portion and is sized to frictionally slide completely into the open front end of the existing mail box housing and into the existing mail compartment thereof defined by the existing housing sidewalls;

said rectangular bottom portion having opposed vertical sidewalls that are each provided with a thumb screw securing assembly including a threaded opening formed through said vertical sidewall and a thumb screw including a threaded shaft portion companionately threaded to engage said threaded opening of said vertical sidewall and a knob portion;

said threaded shaft being of sufficient length such that a tip end of said threaded shaft is threadably extendable past an exterior side surface of said vertical sidewall at least one-half inch so as to contact the existing housing sidewalls and generate a compressional force against the existing housing sidewalls to secure said housing insert portion within the existing mail compartment;

said facade plate assembly being integrally formed with a front edge of said housing insert portion and including a pivoting access door in connection with a mail receiving cavity formed within said housing insert portion, a decorative facade plate defining an access opening in connection with said mail receiving cavity of said housing insert portion, and a mail flag pivotally attached to said facade plate.

* * * * *